US011087938B2

(12) United States Patent
Watanabe

(10) Patent No.: US 11,087,938 B2
(45) Date of Patent: Aug. 10, 2021

(54) SWITCH DEVICE

(71) Applicant: ALPS ALPINE CO., LTD., Tokyo (JP)

(72) Inventor: Yoshiyuki Watanabe, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/014,133

(22) Filed: Sep. 8, 2020

(65) Prior Publication Data

US 2020/0402750 A1 Dec. 24, 2020

Related U.S. Application Data

(63) Continuation of application No. PCT/JP2018/044051, filed on Nov. 29, 2018.

(30) Foreign Application Priority Data

Mar. 26, 2018 (JP) ..... JP2018-059007

(51) Int. Cl.
*H01H 23/06* (2006.01)
*H01H 9/04* (2006.01)

(52) U.S. Cl.
CPC ..... *H01H 23/06* (2013.01); *H01H 9/04* (2013.01); *H01H 2223/00* (2013.01)

(58) Field of Classification Search
CPC .. H01H 2223/002; H01H 13/86; H01H 13/06; H01H 21/08; H01H 23/06;
(Continued)

(56) References Cited

U.S. PATENT DOCUMENTS 5,493,087 A * 2/1996 Yoshida ..... H01H 13/06 200/302.1
2006/0260920 A1* 11/2006 Ami ..... H01H 9/04 200/302.3

(Continued)

FOREIGN PATENT DOCUMENTS

JP 2000-011807 1/2000
JP 2006-172928 6/2006

(Continued)

OTHER PUBLICATIONS

International Search Report for PCT/JP2018/044051 dated Mar. 5, 2019.

*Primary Examiner* — Ahmed M Saeed
(74) *Attorney, Agent, or Firm* — IPUSA, PLLC

(57) ABSTRACT

A switch device that includes a switch, a casing, side wall portions extending in a first direction from the casing, front and back wall portions extending in the first direction from the casing, a dust-proof portion extending from the back wall portion, and an operation knob including an upper surface portion swingable in a second direction perpendicular to the first direction and a third direction opposite to the second direction and covers the dust-proof portion, and a back surface portion extending in a fourth direction opposite to the first direction from the back end of the upper surface portion and faces a part of the dust-proof portion, wherein the side wall portions, the front wall portion, and the back wall portion form a substantially rectangular shape, the side wall portions, the front wall portion, and the dust-proof portion form another substantially rectangular shape greater than the substantially rectangular shape.

9 Claims, 10 Drawing Sheets

(58) Field of Classification Search
CPC .... H01H 9/04; H01H 23/003; H01H 2300/01; H01H 13/705; H01H 2221/016; H01H 2225/018; H01H 2231/026; H01H 2237/006; H01H 19/635; H01H 2021/225; H01H 21/22; H01H 21/50; H01H 2221/018; H01H 2239/058; H01H 23/143; H01H 23/162; H01H 23/205; H01H 25/008; H01H 9/181
See application file for complete search history.

(56) References Cited

U.S. PATENT DOCUMENTS

| | | | | |
|---|---|---|---|---|
| 2006/0283696 | A1 | 12/2006 | Koyama | |
| 2007/0023269 | A1* | 2/2007 | Shimizu | H01H 23/06 200/302.3 |
| 2013/0134029 | A1 | 5/2013 | Kokubu et al. | |
| 2014/0069787 | A1* | 3/2014 | Hisada | H01H 23/06 200/302.3 |

FOREIGN PATENT DOCUMENTS

| | | |
|---|---|---|
| JP | 2006-351443 | 12/2006 |
| JP | 2013-097944 | 5/2013 |
| JP | 2013-110050 | 6/2013 |

* cited by examiner

SWITCH DEVICE

CROSS-REFERENCE TO RELATED APPLICATIONS

The present application is a continuation application of International Application No. PCT/JP2018/044051, filed Nov. 29, 2018, which claims priority to Japanese Patent Application No. 2018-059007, filed Mar. 26, 2018. The contents of these applications are incorporated herein by reference in their entirety.

BACKGROUND OF THE INVENTION

1. Field of the Invention

The present invention relates to a switch device.

2. Description of the Related Art

A switch device with an operation knob capable of swinging backward and frontward has been used as a power window switch of a vehicle. In this switch device, an operation knob is pivotally mounted in front and back directions onto a cylinder extending upward from the casing, in which the front and back switches are accommodated and is provided with a pressing portion for pressing the front and back switches. A coupling member is provided on the switch to coupling the pressing portion of the operation knob to the switch. When the user lifts the back portion of the operation knob, the operation knob swings frontward, the pressing portion presses while sliding a front portion of the coupling member, and a front switch is turned ON. Similarly, when the user pushes down a back portion of the operation knob, the operation knob swings backward, the pressing portion slides and presses a back portion of the coupling member, and the back switch is turned ON, as disclosed in Japanese Laid-Open Patent Application No. 2000-11807

SUMMARY OF THE INVENTION

A switch device according to an embodiment includes a switch, a casing accommodating the switch, a pair of side wall portions extending in a first direction from the casing, a front wall portion extending in the first direction from the casing, a back wall portion extending in the first direction from the casing, a dust-proof portion extending from the back wall portion, and an operation knob including an upper surface portion which is mounted on the casing so as to be swingable in a second direction perpendicular to the first direction and a third direction opposite to the second direction and covers the dust-proof portion along the first direction, and a back surface portion which extends in a fourth direction opposite to the first direction from the back end of the upper surface portion and faces at least a part of the dust-proof portion, wherein, in a plan view observed in the first direction, the side wall portions, the front wall portion, and the back wall portion form a substantially rectangular shape, wherein the side wall portions, the front wall portion, and the dust-proof portion form a substantially rectangular shape, and wherein the substantially rectangular shape formed by the side wall portions, the front wall portion, and the dust-proof portion is greater than the substantially rectangular shape formed by the side wall portions, the front wall portion, and the back wall portion.

Effect of the Invention

According to each embodiment of the present invention, a switch device can be provided that prevents foreign matter from entering the inside of a cylinder.

BRIEF DESCRIPTION OF THE DRAWINGS

FIG. 9 is a cross-sectional view of the switch device when the switch 3B is turned ON.

FIG. 10 is a cross-sectional view of the switch device when the switch 3F is turned ON.

DESCRIPTION OF THE EMBODIMENTS

Figure 1:
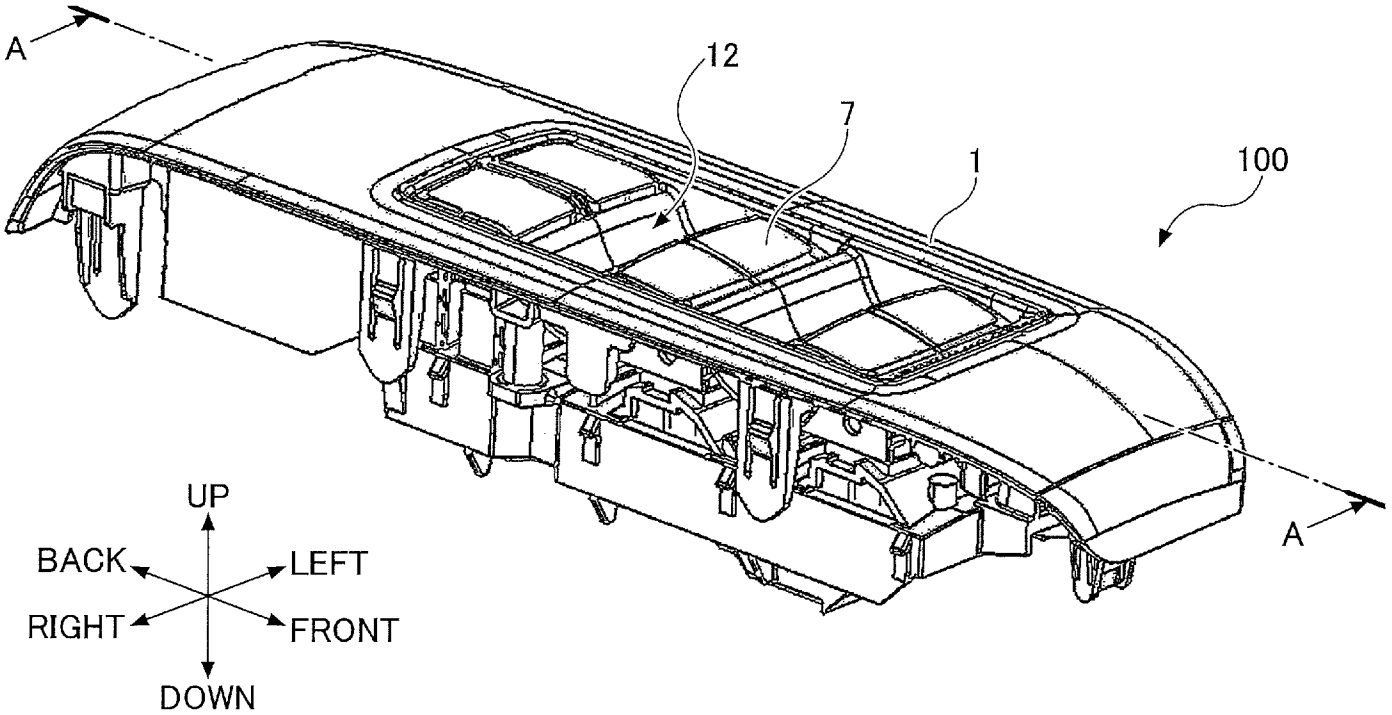
FIG. 1 is an external perspective view illustrating an example of a switch device.

In a switch device described above, when a user lifts the back portion of an operation knob, a negative pressure is generated in a space under the back portion of the operation knob, and foreign matter such as dust may enter this gap. This foreign matter intruded into the inside of the cylinder through the gap between the operation knob and the cylinder, and when the pressing part of the operation knob sandwiched between the connecting member, abnormal friction occurred during sliding of the pressing part, which caused damage to the operation knob and the coupling member.

The present invention has been devised in view of the above-described problems, and the present disclosure is to provide a switch device in which the intrusion of foreign matter into the cylinder is suppressed.

Hereinafter, each embodiment of the present invention will be described with reference to the accompanying drawings. In the description and drawings concerning each embodiment, components having substantially the same functional structure, the overlapping description is omitted by allocating the same reference numerals.

The switch device 100 according to one embodiment will be described with reference to FIGS. 1 to 11. The switch device 100 according to this embodiment is a switch device having an operation knob that is swingable in front and back directions and is applicable to an arbitrary switch device including a power window switch for a vehicle.

Figure 2:
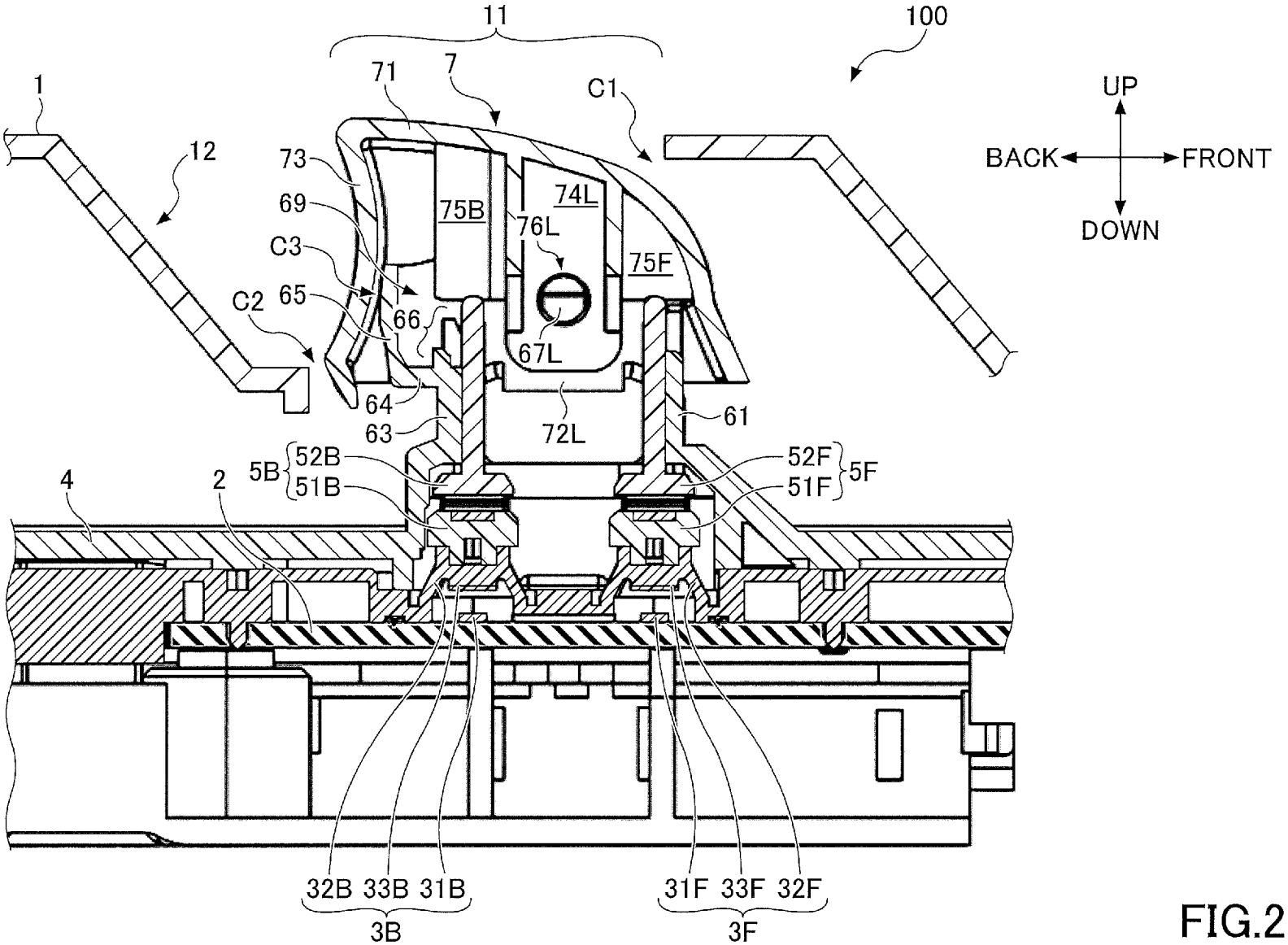
FIG. 2 is a cross-sectional view of the switch device illustrated in FIG. 1 taken along a line A-A.

FIG. 1 is a perspective view illustrating an appearance of an example of the switch device 100. FIG. 2 is a cross-sectional view taken along an A-A line of the switch device 100 illustrated in FIG. 1. FIGS. 1 and 2 illustrate the switch device 100 in a state where the operation knob 7 is not operated. As illustrated in FIGS. 1 and 2, the switch device 100 includes a cover 1, a substrate 2, switches 3F and 3B, a casing 4, coupling members 5F and 5B, a cylinder 6, and an operation knob 7. In the example of FIG. 1, the switch device 100 includes a plurality of operating knobs 7, but each operation knob 7 and its underlying structure are identical. The switch device 100 may include only one operation knob 7 and its underlying structure. Hereinafter, the direction illustrated in FIG. 1 will be described as the direction of the switch device 100.

A cover 1 is a member that covers the upper surface of the switch device 100 while the operation knob 7 is exposed. As illustrated in FIG. 2, the cover 1 includes an opening 11 through which an operation knob 7 is inserted and a recessed portion 12 provided behind the operation knob 7. By inserting a finger into the recessed portion 12, the user can lift the back of the operation knob 7 and swing the operation knob 7 frontward. In addition, the cover 1 is formed so as not to collide with the operation knob 7 when the operation knob 7 is swung. For this reason, a gap C1 having a predetermined width is provided between the front end portion of the opening 11 of the cover 1 and the operation knob 7. Similarly, a gap C2 having a predetermined width is provided between the back end portion of the opening 11 of the cover 1 and the operation knob 7. Preferably, the gaps C1 and C2 are as narrow as possible in order to prevent foreign matter from entering under the cover 1.

The substrate 2 is a printed wiring board having printed wiring (not illustrated). The substrate 2 is secured to the casing 4. The substrate 2 may be a rigid substrate or a flexible substrate. The ON signals of the switches 3F and 3B are output to an external device via the substrate 2.

The switches 3F and 3B are switches provided on the substrate 2. The switches 3F and 3B are turned OFF when the operation knob 7 is not operated and turned ON when the operation knob 7 is swung. More specifically, the switch 3F is positioned ahead of the switch 3B and is turned ON when the operation knob 7 is swung frontward. The switch 3B is positioned behind the switch 3F and is turned ON when the operation knob 7 is swung backward. The structure of the switch 3F will be described below. Because the structure of the switch 3B is the same as that of switch 3F, the description is omitted.

The switch 3F includes two fixed contacts 31F, a dome portion 32F, and a movable contact 33F. The two fixed contacts 31F are contacts provided on the substrate 2, respectively connected to the printed wiring and insulated from each other. The dome portion 32F is a dome-like resilient member that covers the upper portion of the fixed contact 31F. When the dome portion 32F is pressed downward, it is elastically deformed so that the lower surface contacts the upper surface of the substrate 2. When the pressing is stopped, the dome portion 32F returns to its original shape due to elasticity. The dome portion 32F is formed of a resilient resin such as silicone rubber or a metal dish spring. The movable contact 33F is a contact fixed to the lower surface of the dome portion 32F and is arranged so that it can be contacted simultaneously with the two fixed contacts 31F when the dome portion 32F is pressed downward. With such a structure, when the dome portion 32F is pressed downward, the two fixed contacts 31F are connected through the movable contact 33F, and the switch 3F is turned ON.

The structure of the switch 3F is not limited to the above example. For example, the fixed contact 31F connected to the printed wiring may be provided on the substrate 2 and the movable contact 33F may be connected to the printed wiring. In this structure, when the dome portion 32F is pressed from above, the movable contact 33F and the fixed contact 31F are connected, and the switch 3F is turned ON.

Figure 3:
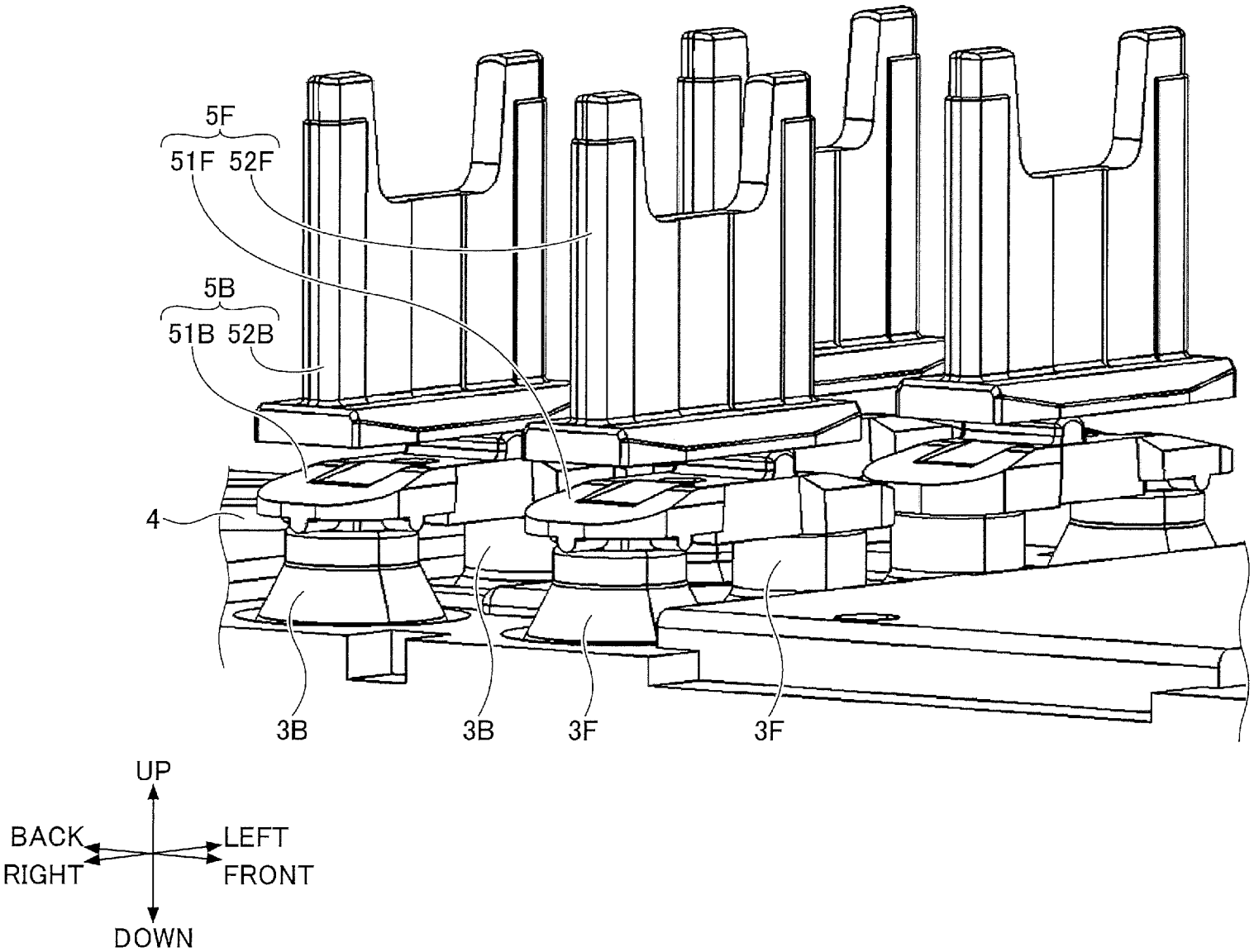
FIG. 3 is a partially enlarged perspective view illustrating an internal structure of the switch device illustrated in FIG. 1.

FIG. 3 is an enlarged perspective view illustrating a part of the internal structure of the switch device 100 of FIG. 1. FIG. 3 corresponds to a partial enlarged perspective view of the switch device 100 in which the cover 1, the cylinder 6, and the operation knob 7 are removed. In the example of FIG. 3, the switch device 100 includes two switches 3F arranged in left-right directions and two switches 3B arranged in the left-right directions. However, in this embodiment, the switch device 100 may include one switch 3F and three or more switches 3F aligned in the left-right directions. Similarly, in this embodiment, the switch device 100 may include one switch 3B and three or more switches 3B aligned in the left-right directions.

The casing 4 is a housing of the switch device 100 and accommodates the switches 3F and 3B inside as illustrated in FIG. 2. The casing 4 has an opening for inserting at least the coupling members 5F, 5B upward. The cover 1, substrate 2, and cylinder 6 are fixed to the casing 4.

The coupling members 5F and 5B are members that couple the switches 3F and 3B and the operation knob 7 so that the switches 3F and 3B are turned ON in response to swinging of the operation knob 7. The coupling member 5F is provided on the switch 3F so that the switch 3F turns ON when the operation knob 7 swings frontward, and couples the switch 3F to the pressing portion 75F of the operation knob V. The coupling member 5B is provided on the switch 3B so that the switch 3B turns ON when the operation knob 7 swings backward, and couples the switch 3B to the pressing portion 75B of the operation knob 7. The pressing portions 75F and 75B are described later. The structure of the coupling member 5F will be described below. Because the structure of the coupling member 5B is the same as that of the coupling member 5F, the description thereof will not be repeated.

The coupling member 5F includes a cam 51F and an actuator 52F. The cam 51F is a member that transmits force from the actuator 52F to the dome portion 32F of the switch 3F and is positioned over the two switches 3F as illustrated in FIG. 3. The actuator 52F is a plate-like member that transmits force from the pressing portion 75F to the cam 51F and is disposed upright on the cam 51F. The upper end of the actuator 52F contacts the lower end of the pressing portion 75F. In this structure, when the pressing portion 75F is lowered and the actuator 52F is pressed downward, the actuator 52F presses downward the cam 51F, and the cam 51F presses downward the dome portion 32F and turns ON the switch 3F.

The structure of the coupling member 5F is not limited to the above-described example. The coupling member 5F may not include the cam 51F, and the actuator 52F may be positioned over both of the two switches 3F. In this structure, when the pressing portion 75F is lowered and the actuator 52F is pressed downward, the actuator 52F presses the dome portion 32F downward and the switch 3F is turned ON.

Figure 4:
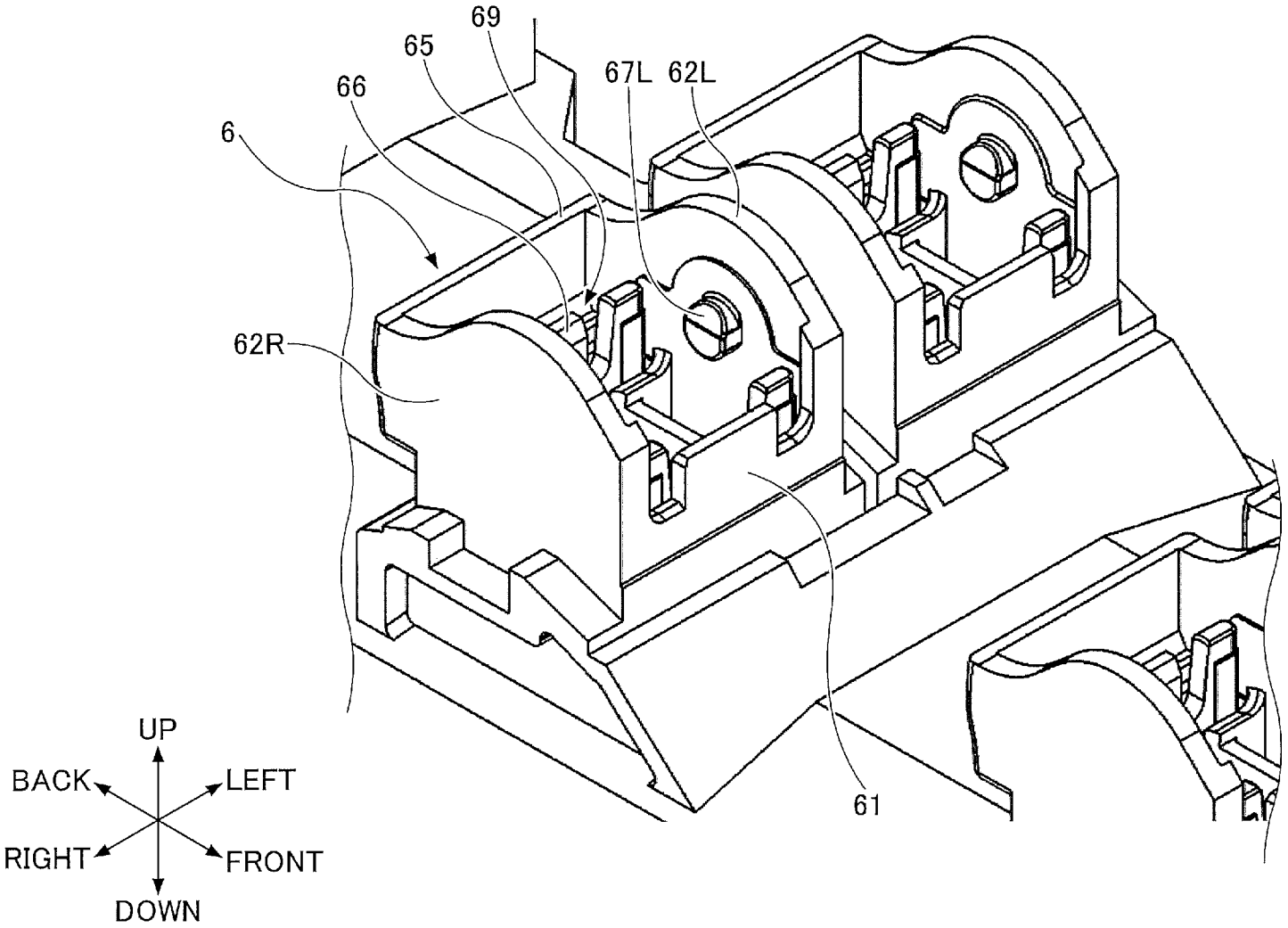
FIG. 4 is a partially enlarged perspective view illustrating the internal structure of the switch device illustrated in FIG. 1.
Figure 5:
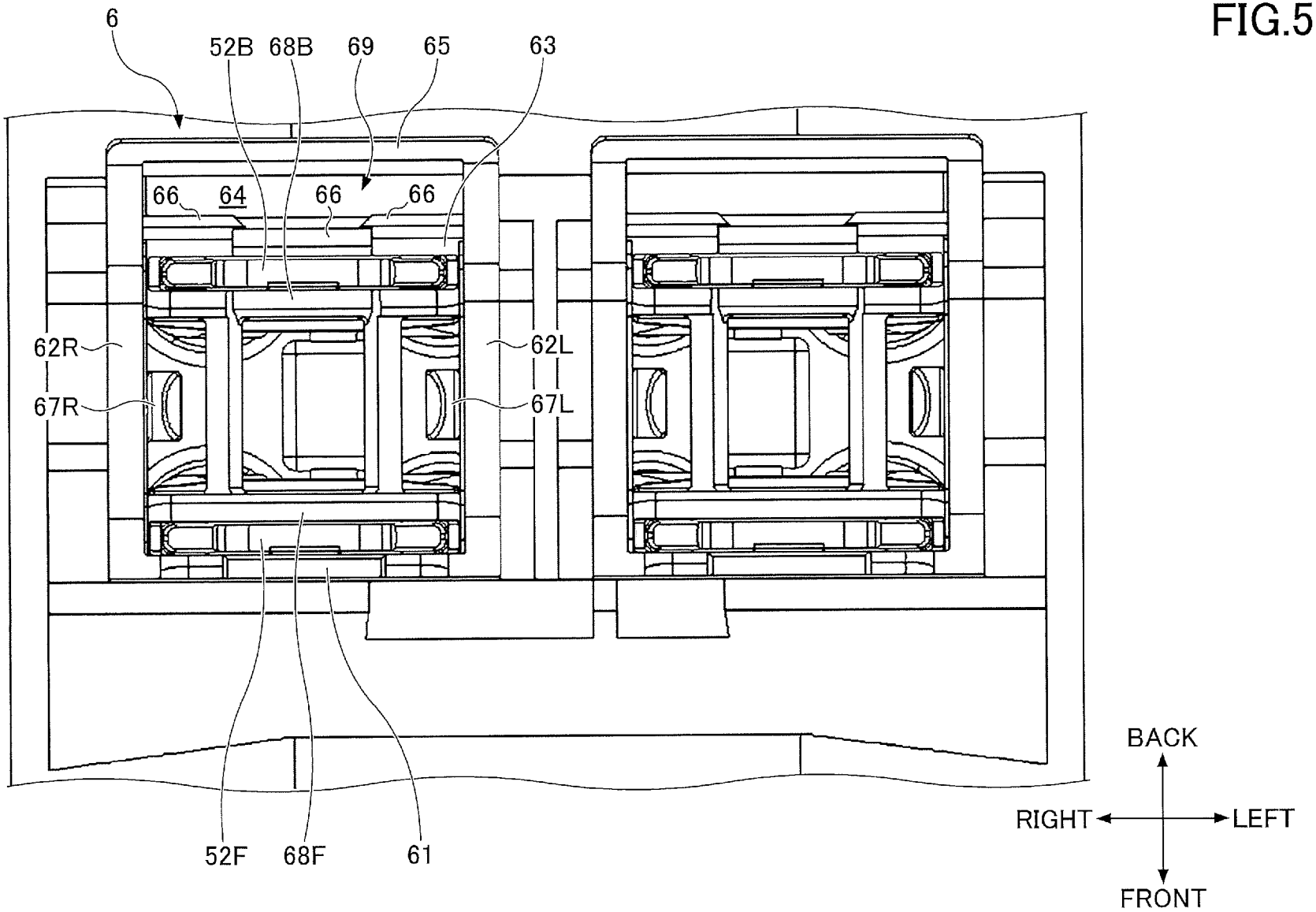
FIG. 5 is a plan view of FIG. 4.
Figure 6:
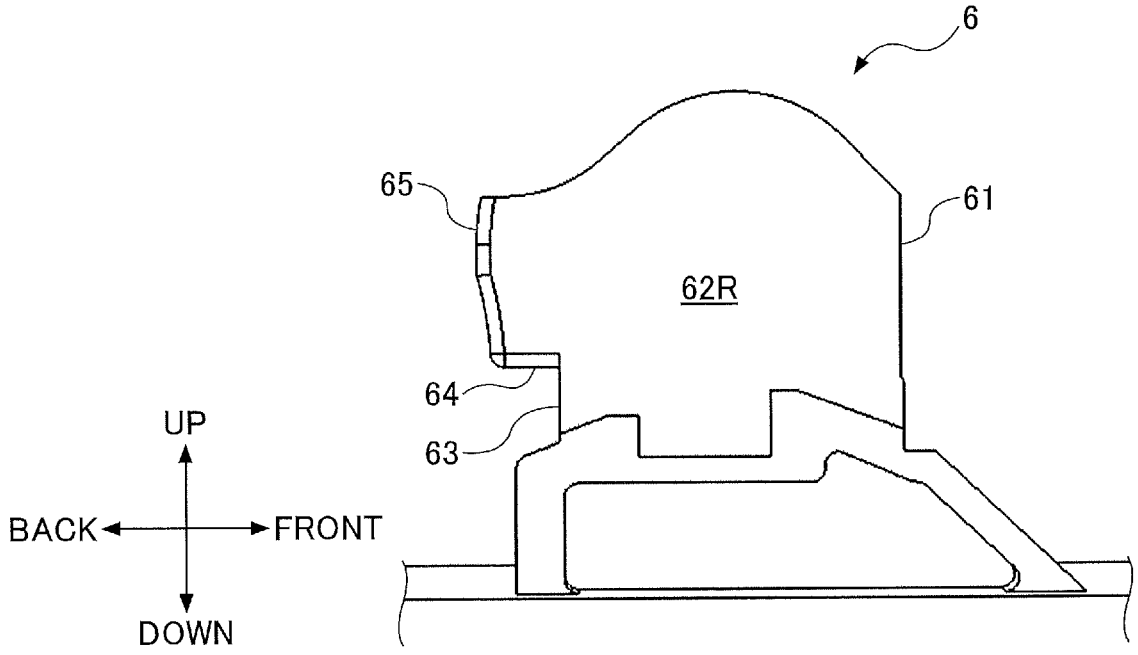
FIG. 6 is a side view of FIG. 4.

The cylinder 6 is a cylindrical member extending upward from the casing 4. The cylinder 6 may be formed integrally with the casing 4. FIG. 4 is an enlarged perspective view illustrating a part of the internal structure of the switch device 100 illustrated in FIG. 1. FIG. 4 corresponds to an enlarged perspective view of a part of the switch device 100 in which the cover 1 and the operation knob 7 are omitted. FIG. 5 is a plan view of FIG. 4. FIG. 6 is a side view of FIG. 4.

As illustrated in FIGS. 4-6, the cylinder 6 has a front wall portion 61 extending upward from the casing 4, a pair of side wall portions 62R and 62L, and a back wall portion 63, a first dust-proof portion 64, a second dust-proof portion 65, and a third dust-proof portion 66. The front wall portion 61, the side wall portion 62R and 62L, the back wall portion 63, the first dust-proof portion 64, and the second dust-proof portion 65 form a cylindrical shape with a plane-visible rectangular shape with an upper opening.

The front wall portion 61 is a front surface of the cylinder 6 and is formed to have at least a low portion so that, when the operation knob 7 swings frontward, it does not collide with the pressing portion 75F, as illustrated in FIG. 4.

Side wall portions 62R and 62L are the right and left sides of the cylinder 6, respectively, and are positioned to face to cover the side ends of the front wall portion 61, the back wall portion 63, the first dust-proof portion 64, and the second dust-proof portion 65. The side wall portions 62R and 62L are formed on an arc of at least a portion of the upper end thereof so as not to collide with the upper surface portion 71 when the operation knob 7 swings. The upper surface portion 71 will be described later. As illustrated in FIG. 5, the side wall portions 62R and 62L are provided with the shaft portions 67R and 67L that are the swing center of the operation knob 7 facing each other. In the example of FIG. 5, the shaft portions 67R and 67L protrude inwardly of the cylinder 6, but may protrude outwardly of the cylinder 6. A support portion 68F for supporting the actuator 52F in an upright position and a support portion 68B for supporting the actuator 52B in an upright position are provided between the side wall portions 62R and 62L. The support portion 68F is disposed to face the front wall portion 61 with an actuator 52F sandwiched therebetween. An upright state of the actuator 52F is maintained by sandwiching the front and back portions of the actuator 52F between the support portion 68F and the front wall portion 61. The support portion 68B is positioned to face the back wall portion 63 with the actuator 52B sandwiched therebetween. The upright state of the actuator 52B is maintained by sandwiching the front and back sides of the actuator 52B between the support portion 68B and the back wall portion 63.

As illustrated in FIG. 6, the back wall portion 63 is present on the lower back surface of the cylinder 6 and is formed to be lower than the side wall portions 62R and 62L. The back wall portion 63 is positioned to face the front wall portion 61.

The first dust-proof portion 64 is the bottom surface of the dust collecting portion 69 described later, and extends backward from the upper end of the back wall portion 63. In the example of FIG. 6, the first dust-proof portion 64 extends horizontally from the upper end of the back wall portion 63, but may also extend upward or downward with a gradient.

The second dust-proof portion 65 is present on the upper back surface of the cylinder 6 and extends upward from the back end of the first dust-proof portion 64. The second dust-proof portion 65 is disposed so as to face the back surface portion 73 of the operation knob 7 as illustrated in FIG. 2. The back surface portion 73 will be described later. A gap C3 having a predetermined width is provided between the second dust-proof portion 65 and the back surface portion 73 so as not to cause a collision between the second dust-proof portion 65 and the back surface portion 73 when the operation knob 7 swings. In order to prevent foreign matter from entering the inside of the cylinder 6, it is preferable that the gap C3 be narrow.

Preferably, at least a portion of the back surface of the second dust-proof portion 65 is shaped along the trajectory of the back surface portion 73 during swing of the operation knob 7. For example, in the example of FIG. 6, the upper portion of the second dust-proof portion 65 has an arc shape centered on the shaft portions 67R and 67L along the trajectory of the back surface portion 73 during swinging. By such a structure, the gap C3 can be narrowed while preventing the collision between the second dust-proof portion 65 and the back surface portion 73 during swinging of the operation knob 7.

It is preferable that at least a part of the back surface of the second dust-proof portion 65 has a shape along the back surface portion 73 when the operation knob 7 is swung to the back end (a position where the switch 3B is turned ON). For example, in the example of FIG. 6, the lower portion of the second dust-proof portion 65 has a curved shape along the back surface portion 73 when the operation knob 7 is swung to the back end. In this structure, the gap C3 can be narrowed while preventing the collision between the second dust-proof portion 65 and the back surface portion 73 when the operation knob 7 is swung to the back end.

The third dust-proof portion 66 is present on a front surface of the dust-collecting portion 69, which will be described later, and extends upward from the upper surface portion of the first dust-proof portion 64, as illustrated in FIG. 2. As illustrated in FIG. 5, the third dust-proof portion 66 is formed between the side wall portions 62R and 62L, and is formed to have at least a lower part so as not to collide with the pressing portion 75B when the operation knob 7 swings backward.

According to this embodiment, the dust collecting portion 69 is formed by the side wall portions 62R and 62L, the first dust-proof portion 64, the second dust-proof portion 65, and the third dust-proof portion 66. The dust collecting portion 69 is a gap surrounded by the side wall portions 62R and 62L, the first dust-proof portion 64, the second dust-proof portion 65, and the third dust-proof portion 66. The front, side, back and bottom surfaces of the dust collecting portion 69 are formed by the third dust-proof portion 66, the side wall portions 62R and 62L, the second dust-proof portion 65 and the first dust-proof portion 64, respectively. As will be described later, in the dust collecting portion 69, foreign matter that enters the inside of the cylinder 6 accumulates.

Figure 7:
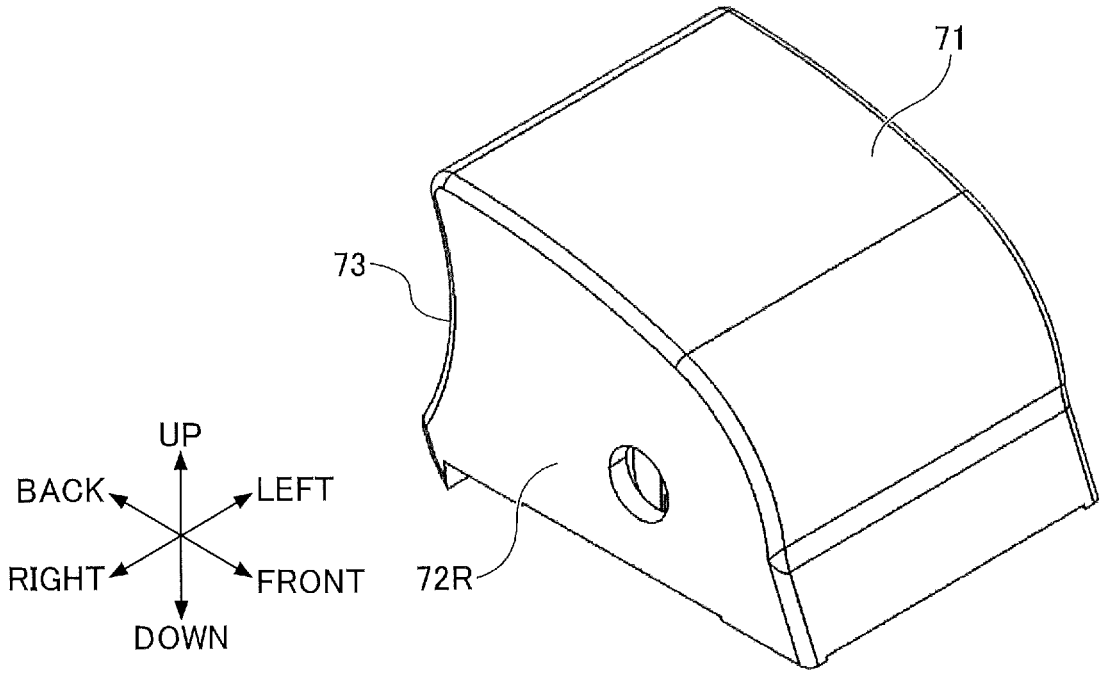
FIG. 7 is an enlarged perspective view illustrating an operation knob.
Figure 8:
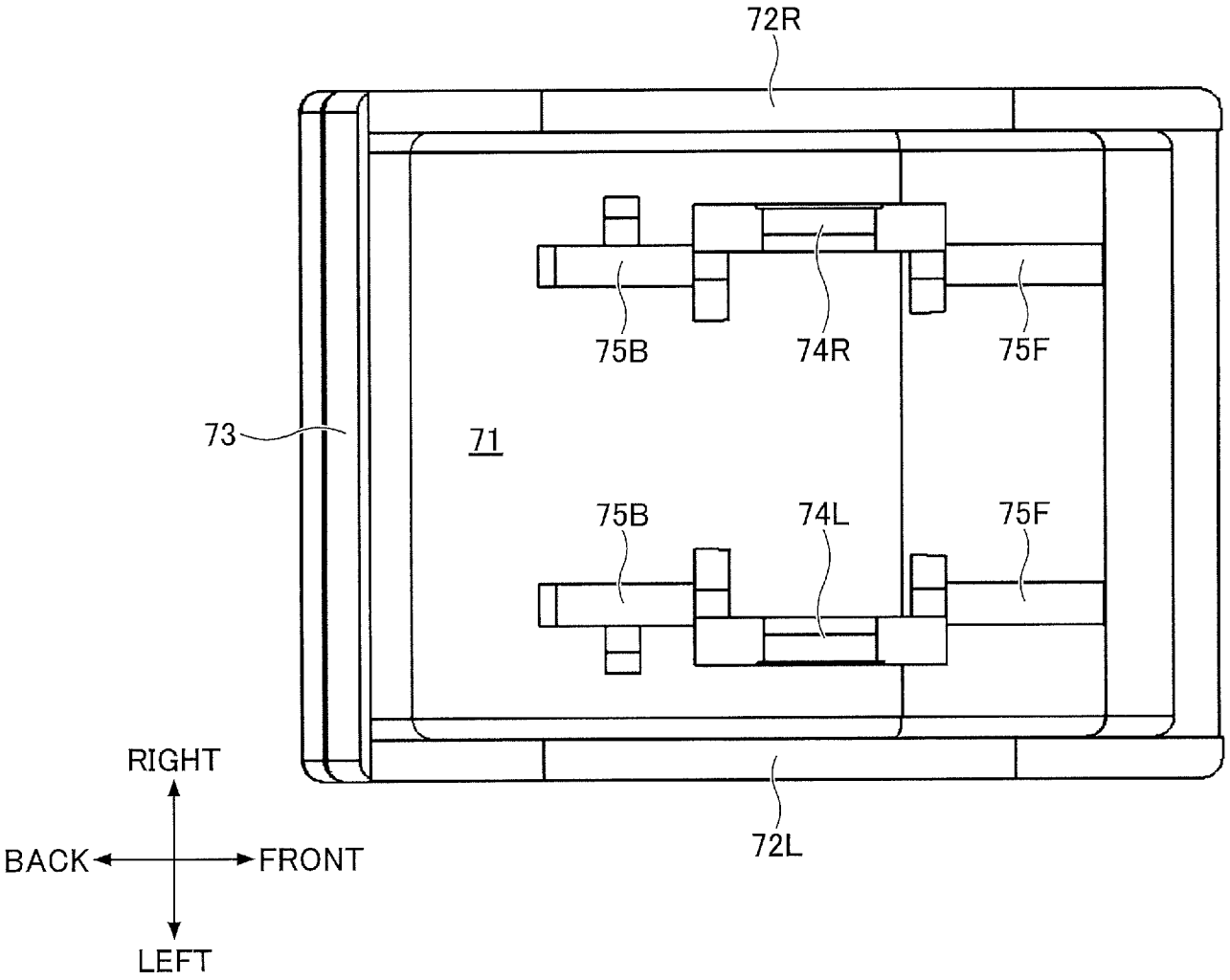
FIG. 8 is a bottom view illustrating the operation knob.

The operation knob 7 is an operation portion for operation by a user and is swingably mounted to the cylinder 6 in a front and back directions so as to cover the upper portion of the cylinder 6. Here, FIG. 7 is an enlarged perspective view of the operation knob 7. FIG. 8 is a bottom view of the operation knob 7. As illustrated in FIGS. 7 and 8, the operation knob 7 has an upper surface portion 71, a pair of side portions 72R and 72L, and a back surface portion 73.

The upper surface portion 71 is the upper surface portion of the operation knob 7 and covers the upper surface of the cylinder 6. The upper surface portion 71 has a convex curved shape that descends from the back end toward the front end, as illustrated in FIG. 7. The operation knob 7 swings backward by a user pushing down on the back surface portion of the upper surface portion 71. The shape of the upper surface portion 71 is not limited to the example of FIG. 7. The lower surface of the upper surface portion 71 is provided with downward extending mounting portions 74R and 74L and pressing portions 75F and 75B.

The mounting portions 74R and 74L are portions for mounting the operation knob 7 to the cylinder 6. The mounting portions 74R and 74L are arranged laterally and laterally so that they are positioned to the right and left, respectively, and are provided in overlap with the shaft portions 67R and 67L, respectively. As illustrated in FIG. 2, the mounting portion 74L has an opening 76L through which the shaft portion 67L fits in a portion overlapping the shaft portion 67L. Similarly, the mounting portion 74R has an opening 76R through which the shaft portion 67R fits in a portion overlapping the shaft portion 67R. When the shaft portions 67L and 67R are fitted to the openings 76L and 76R, the operation knob 7 can swing in a frontward direction with the shaft portions 67L and 67R as the center.

The pressing portions 75F and 75B are respectively portions for pressing the connecting members 5F and 5B downward. The pressing portion 75F is disposed so that its lower end contacts the upper end of the actuator 52F when the control knob 7 is not operated and is positioned ahead of the mounting portions 74R and 74L. The pressing portion 75F presses the actuator 52F downward when the operation knob 7 swings frontward. The pressing portion 75B is disposed so that the lower end thereof contacts the upper end of the actuator 52B and is positioned behind the mounting portions 74R and 74L when the operation knob 7 is not operated. The pressing portion 75B presses the actuator 52B downward when the operation knob 7 swings backward.

In the example of FIG. 8, two pressing portions 75F are disposed side by side in right and left directions. The two pressing portions 75B are arranged side by side. By such a structure, the actuators 52F and 52B can be evenly pressed laterally when the operation knob 7 is swung. However, in this embodiment, the switch device 100 may include one pressing portion 75F and three or more pressing portions. The pressing portions 75F and 75B may be integrally formed.

The side portions 72R and 72L are the right and left side surfaces of the operation knob 7, respectively, and are disposed to face each other with respect to the upper surface portion 71.

The back surface portion 73 is the back face of the operation knob 7 and extends downward from the back end of the upper surface portion 71 and is disposed to face the second dust-proof portion 65. The user lifts the back surface portion 73 with the finger inserted in the recessed portion 12 so that the operation knob 7 swings frontward. The back surface 73 is formed to have a convex curved shape at the front position for ease of operation by the user.

Next, an operation of the switch device 100 according to the present embodiment will be described. Hereinafter, an operation of the switch device 100 when the user turns on the switches 3F and 3B will be described respectively. The initial state of the switch device 100 is assumed to be a non-operational state.

Figure 9:
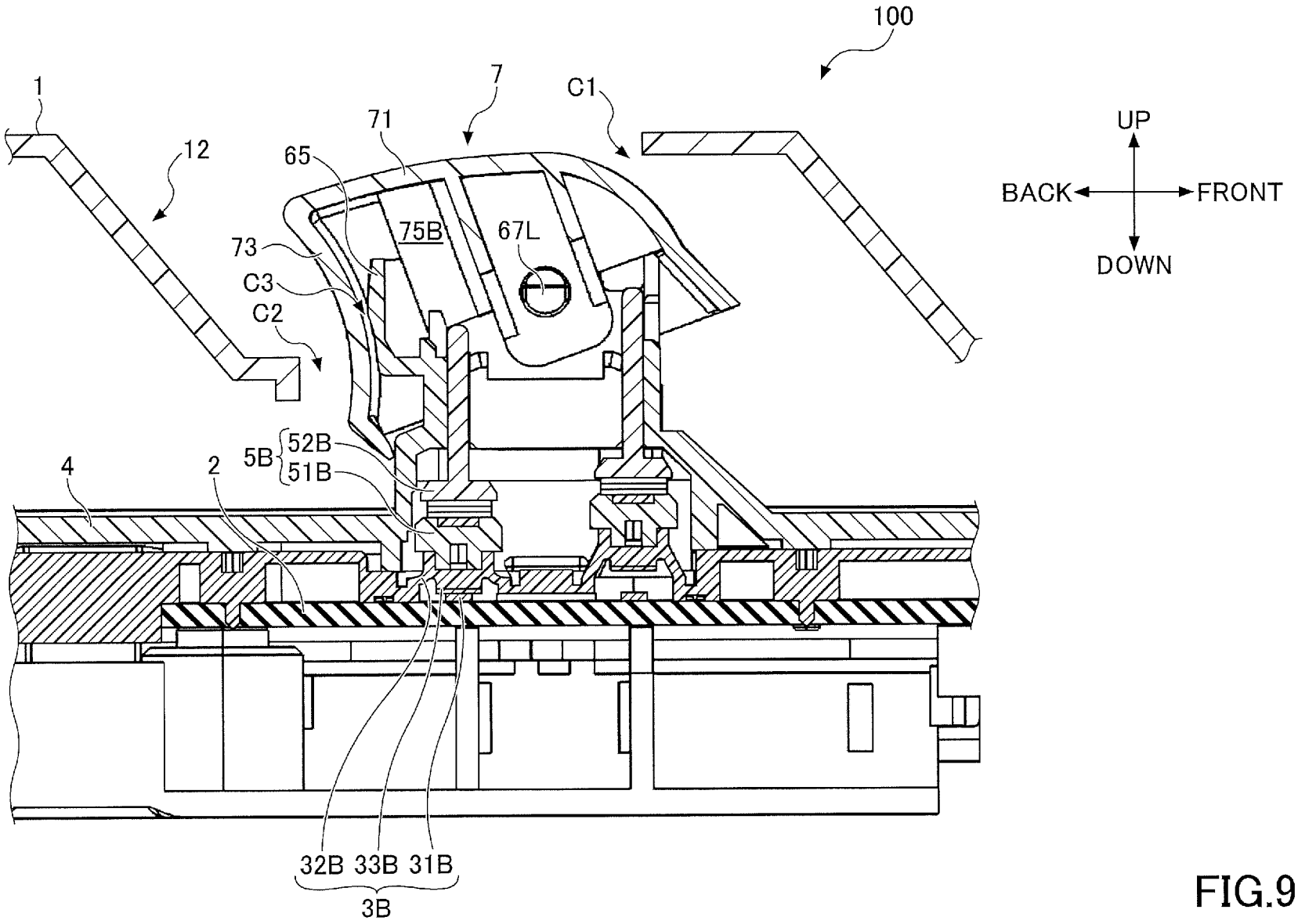

First, the operation of the switch device 100 when the user turns on the switch 3B will be described. FIG. 9 is a cross-sectional view of the switch device 100 when the witch 3B is turned ON.

When the switch 3B is turned ON, the user pushes down the back portion of the upper surface portion 71 of the operation knob 7. When the user pushes down on the back portion of the upper surface portion 71, the operation knob 7 swings backward about the shaft portions 67R and 67L. When the operation knob 7 swings backward, the pressing portion 75B slides down on the actuator 52B and presses down the actuator 52B. As illustrated in FIG. 9, the actuator 52B moves down, the cam 51B moves down, the dome portion 32B resiliently deforms, the movable contact 33B contacts the fixed contact 31B, and the switch 3B turns ON.

As illustrated in FIG. 9, the lower portion of the second dust-proof portion 65 is curved along the back surface portion 73 when the operation knob 7 is swung to the back end. Therefore, the gap C3 can be narrowed while preventing the collision between the second dust-proof portion 65 and the back surface portion 73 when the switch 3B is turned on.

When the user stops pressing the upper surface portion 71 after turning the switch 3B ON, the dome portion 32B resiliently returns to its original shape, the movable contact 33B is separated from the fixed contact 31B, and the switch 3B is turned OFF. The cam 51B rises, the actuator 52B rises, and the actuator 52B presses the pressing portion 75B upward. As a result, the pressing portion 75B slides and moves up on the actuator 52B, the operation knob 7 swings frontward, and the switch device 100 returns to the initial state (the state at the time of non-operation).

Figure 10:
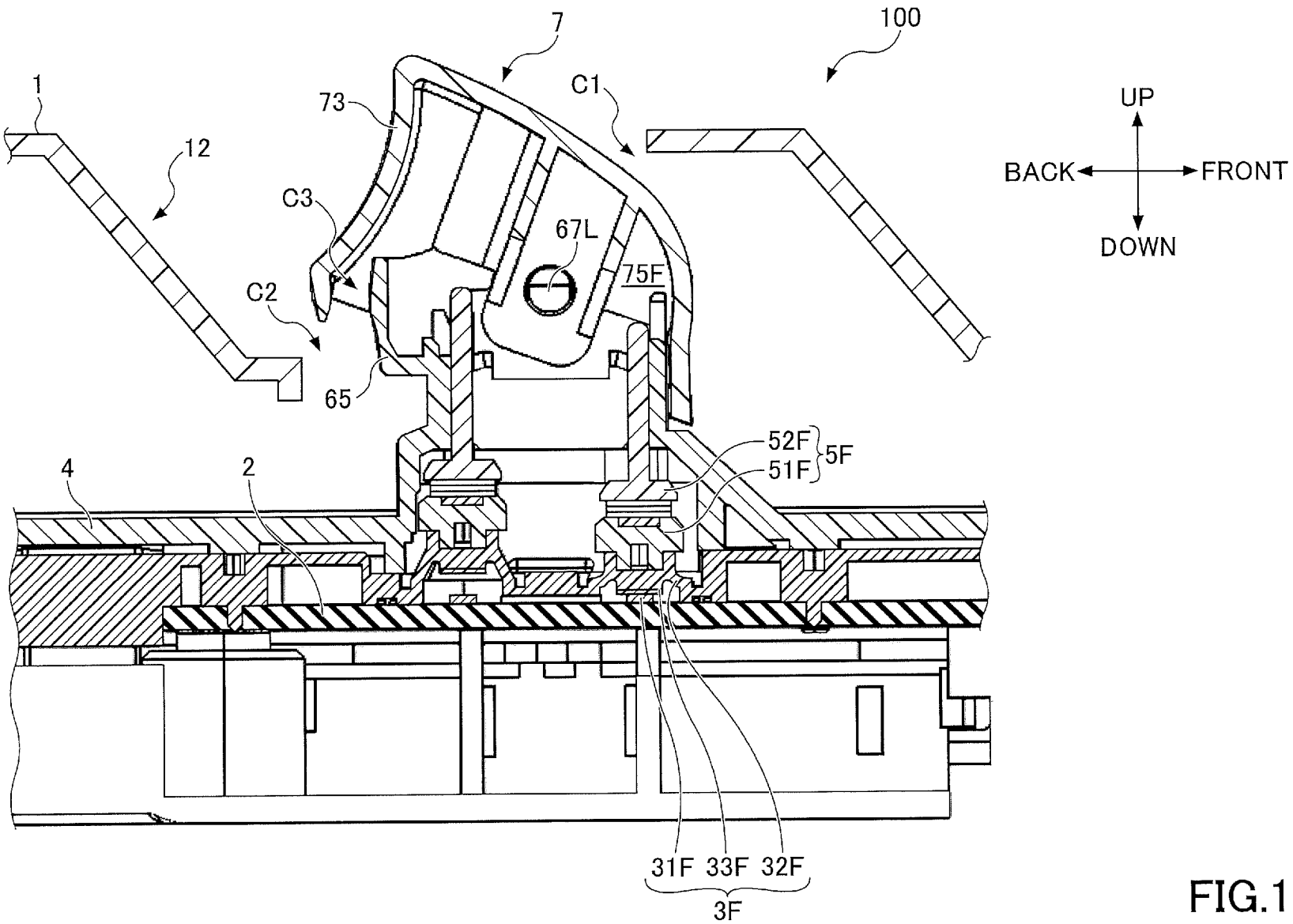

Next, an operation of the switch device 100 when the user turns on the switch 3F will be described. FIG. 10 is a cross-sectional view of the switch device 100 when the switch 3F is turned ON.

When the switch 3F is turned ON, the user lifts the back surface portion 73 of the operation knob 7 while the finger enters the recessed portion 12. When the user lifts the back surface portion 73, the operation knob 7 swings frontward around the shaft portions 67R and 67L. When the operation knob 7 swings frontward, the pressing portion 75F slides down on the actuator 52F and presses the actuator 52F downward. Therefore, as illustrated in FIG. 10, the actuator 52F moves down, the cam 51F moves down, the dome portion 32F is elastically deformed, the movable contact 33F contacts the fixed contact 31F, and the switch 3F turns ON.

As illustrated in FIG. 10, the upper portion of the second dust-proof portion 65 has an arc shape centered on the shaft portions 67R and 67L along the trajectory of the back surface portion 73 during the swing, so that the gap C3 can be narrowed while preventing the collision between the second dust-proof portion 65 and the back surface portion 73 during the operation of turning the switch 3F ON.

When the user releases the back surface portion 73 after turning ON the switch 3F, the dome portion 32F resiliently returns to its original shape, the movable contact 33F is separated from the fixed contact 31F, and then the switch 3F is turned OFF. The cam 51F rises, the actuator 52F rises, and the actuator 52F presses the pressing portion 75F upward. As a result, the pressing portion 75F slides to move up on the actuator 52F, the operation knob 7 swings backward, and the switch device 100 returns to the initial state (the state at the time of non-operation).

Figure 11:
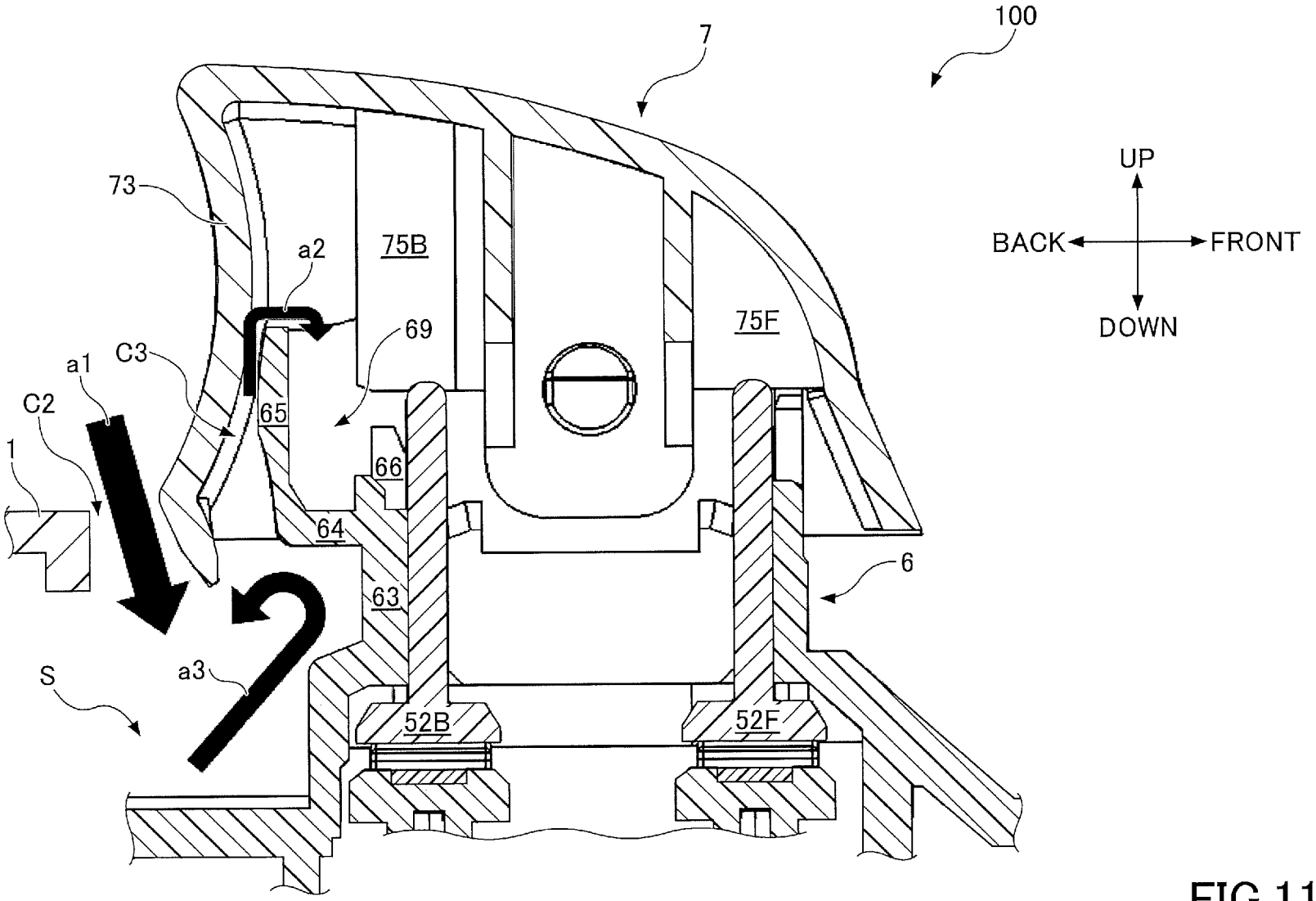
FIG. 11 is a view illustrating the effect of the switch device.

Here, the effect of the switch device 100 according to this embodiment will be described. FIG. 11 is a diagram illustrating an effect of the switch device 100. The arrows a1-a3 in FIG. 11 illustrate a transfer pathway of the foreign matter.

As described above, the gap C2 is provided between the cover 1 of the switch device 100 and the back surface portion 73, and a gap C3 is provided between the back surface portion 73 and the second dust-proof portion 65. Therefore, there is a risk that foreign matter such as dust may enter the inside of the cylinder 6 through the gaps C2 and C3. In particular, when the user lifts the back portion of the operation knob 7 or releases the finger from the pushed-in operation knob 7, the operation knob 7 swings frontward, and a negative pressure is generated in a space S below the back portion of the operation knob 7. Therefore, the foreign matter is apt to intrude into the space S, and the foreign matter easily enters the inside of the cylinder 6.

Specifically, the foreign matter enters the space S through the gap C2 from the outside of the switch device 100 (arrow a1) and enters the inside of the cylinder 6 through the gap C3 from the space S (arrow a2). Therefore, in order for the foreign matter to intrude the inside of the cylinder 6, an air flow is required to flow upward from the space S and into the inside of the cylinder 6 through the gap C3.

However, according to the present embodiment, because the first dust-proof portion 64 covering a part of the space S is provided, the most part of the air flow flowing upward from the space S is bounced downward by the first dust-proof portion 64 and convectively flows inside the space S (arrow a3). Accordingly, since it is possible to suppress the air flow flowing into the inside of the housing 6 through the gap C3, it is possible to suppress the penetration of the foreign matter into the inside of the cylinder 6.

Further, according to the present embodiment, the second dust-proof portion 65 extending upward narrows the gap C3 and increases an entry path of the foreign matter through the gap C3. Accordingly, it is possible to further suppress the intrusion of the foreign matter into the inside of the cylinder 6.

Further, according to the present embodiment, the foreign matter that intrudes into the inside of the cylinder 6 through the gap C3 can be accumulated by the dust collecting portion 69. Accordingly, even when the foreign matter intrudes into the inside of the cylinder 6, it is possible to prevent the foreign matter from being interposed between the pressing portions 75F and 75B and the actuators 52F and 52B. As a result, abnormal friction during sliding of the pressing portions 75F and 75B caused by the foreign matter being caught therebetween is suppressed, damages to the operation knob 7 and the pressing portions 75F and 75B are suppressed, and the service life of the switch device 100 can be extended.

The present invention is not limited to the above-described structures, such as the structures including combinations with other elements. These points can be modified without departing from the spirit of the present invention, and can be appropriately determined according to an applied mode.

DESCRIPTION OF SYMBOLS

1: Cover
11: Opening
12: Recessed portion
2: Substrate
3F, 3B: Switch
31F, 31B: Fixed contact
32F, 32B: Dome portion
33F, 33B: Movable contact
4: Casing
5F, 5B: Coupling member
51F, 51B: Cam
52F, 52B: Actuator
6: Cylinder
61: Front wall portion
62R, 62L: Side wall portion
63: Back wall portion
64: First dust-proof portion
65: Second dust-proof portion
66: Third dust-proof portion
67R, 67L: Shaft portion
68F, 68B: Supporting portion
69: Dust collecting portion
7: Operation knob
71: Upper surface portion
72R, 72L: Side surface portion
73: Back surface portion
74R, 74L: Mounting portion
75F, 75B: Pressing portion
76R, 76L: Opening
100: Switch device
C1-C3: Gap

What is claimed is:

1. A switch device comprising:
a switch;
a casing accommodating the switch;
a pair of side wall portions extending in a first direction from the casing;
a front wall portion extending in the first direction from the casing;
a back wall portion extending in the first direction from the casing;
a dust-proof portion extending from the back wall portion; and
an operation knob including
an upper surface portion which is mounted on the casing so as to be swingable in a second direction perpendicular to the first direction and a third direction opposite to the second direction and covers the dust-proof portion along the first direction, and
a back surface portion which extends in a fourth direction opposite to the first direction from the back end of the upper surface portion and faces at least a part of the dust-proof portion,
wherein, in a plan view observed in the first direction, the side wall portions, the front wall portion, and the back wall portion form a substantially rectangular shape,
wherein the side wall portions, the front wall portion, and the dust-proof portion form a substantially rectangular shape, and
wherein the substantially rectangular shape formed by the side wall portions, the front wall portion, and the dust-proof portion is greater than the substantially rectangular shape formed by the side wall portions, the front wall portion, and the back wall portion.

2. The switch device according to claim 1,
wherein the dust-proof portion is formed by a first dust-proof portion and a second dust-proof portion,
wherein the first dust proof-portion is provided to extend in the second direction from the back wall portion, and
wherein the second dust proof portion is provided to extend in the first direction from the first dust-proof portion.

3. The switch device according to claim 2,
wherein the first dust-proof portion extends in parallel with the second direction from the back wall portion.

4. The switch device according to claim 2,
wherein a portion of a back surface of the second dust-proof portion has a shape that matches a trajectory of the back surface portion while the operation knob swings,
wherein the first dust-proof portion extends with a gradient relative to the second direction from the back wall portion.

5. The switch device according to claim 2, the switch further comprising:
a third dust-proof portion which is provided to extend in the first direction from the first dust-proof portion and disposed closer to the back wall portion than the second dust-proof portion,
wherein a dust collecting portion is formed by the first dust-proof portion, the second dust-proof portion, and the third dust-proof portion.

6. The switch device according to claim 1,
wherein the side wall portion is disposed to cover side ends of the first dust-proof portion, the second dust-proof portion, the front wall portion, and the back wall portion 63.

7. The switch device according to claim 2, wherein a part of a surface of the second dust-proof portion on a side of the second direction has a shape along a trajectory of the back surface portion during swing of the operation knob.

8. The switch device according to claim 2, wherein a part of a surface of the second dust-proof portion on a side of the second direction has a shape along the back surface portion after the operation knob is moved to an end portion of the second direction.

9. The switch device according to claim 1, wherein the first direction is an upward direction.

* * * * *